US006572966B1

(12) United States Patent
Raskin et al.

(10) Patent No.: US 6,572,966 B1
(45) Date of Patent: Jun. 3, 2003

(54) POLYESTER FIBERS HAVING SUBSTANTIALLY UNIFORM PRIMARY AND SECONDARY CRIMPS

(75) Inventors: Vladimir Y. Raskin, Shoreline, WA (US); Edwin Starke Farley, Jr., Columbia, SC (US); Frederick Lee Travelute, III, Charlotte, NC (US); Mendel Lyde Poston, Jr., Pamplico, SC (US)

(73) Assignee: Wellman, Inc., Shrewsbury, NJ (US)

( * ) Notice: Subject to any disclaimer, the term of this patent is extended or adjusted under 35 U.S.C. 154(b) by 0 days.

(21) Appl. No.: 09/693,413

(22) Filed: Oct. 20, 2000

Related U.S. Application Data

(63) Continuation-in-part of application No. 09/274,190, filed on Mar. 22, 1999, now Pat. No. 6,134,758.

(51) Int. Cl.[7] ..... D01F 6/00

(52) U.S. Cl. ..... 428/362; 428/369; 428/361; 428/357

(58) Field of Search ..... 428/362, 369, 428/357, 361

(56) References Cited

U.S. PATENT DOCUMENTS

| | | | | |
|---|---|---|---|---|
| 3,037,260 A | | 6/1962 | Pike, Jr. | |
| 3,110,076 A | | 11/1963 | Trifunovic et al. | |
| 3,353,222 A | | 11/1967 | Keel et al. | |
| 3,526,023 A | | 9/1970 | Mertens | |
| 3,946,469 A | | 3/1976 | Benson | |
| 4,115,908 A | | 9/1978 | Saxon et al. | |
| 4,395,804 A | | 8/1983 | Saxon et al. | |
| 4,503,593 A | | 3/1985 | Floyd et al. | |
| 4,521,944 A | | 6/1985 | Stockbridge | |
| 4,618,531 A | * | 10/1986 | Marcus | 428/283 |
| 4,783,364 A | * | 11/1988 | Ilan | 428/288 |
| 4,818,599 A | * | 4/1989 | Marcus | 428/288 |
| 4,854,021 A | | 8/1989 | Reinehr et al. | |
| 5,020,198 A | | 6/1991 | Hill et al. | |
| 5,025,538 A | | 6/1991 | Saleh | |
| 5,074,016 A | | 12/1991 | Meyer | |
| 5,112,684 A | * | 5/1992 | Halm et al. | 428/361 |
| 5,238,612 A | * | 8/1993 | Halm | 428/357 |
| 5,338,500 A | | 8/1994 | Halm et al. | |
| 5,344,707 A | * | 9/1994 | Snyder | 428/362 |
| 5,399,423 A | | 3/1995 | McCullough et al. | |
| 5,485,662 A | | 1/1996 | Hodges, Jr. et al. | |
| 5,500,295 A | * | 3/1996 | Halm | 428/357 |
| 5,544,397 A | | 8/1996 | Takehara | |
| 5,591,388 A | | 1/1997 | Sellars et al. | |

FOREIGN PATENT DOCUMENTS

| | | |
|---|---|---|
| CA | 958526 A1 | 12/1974 |
| DE | 3516886 A1 | 11/1996 |
| EP | 0 357 257 A1 | 3/1990 |
| EP | 0 459 826 A1 | 12/1991 |
| FR | 2144180 A1 | 2/1973 |

* cited by examiner

*Primary Examiner*—N. Edwards
(74) *Attorney, Agent, or Firm*—Summa & Allan, P.A.

(57) ABSTRACT

A method is disclosed for producing polyester fibers having uniform primary and secondary crimps. The method includes the steps of advancing fibers into a stuffer box having an upper doctor blade and a lower doctor blade, positioning the upper doctor blade and the lower doctor blade such that the doctor blade gap is broad enough to permit the formation of secondary crimps and yet is narrow enough to maintain primary and secondary crimp uniformity, and then applying a longitudinal force against the advancing fibers to impart uniform primary and secondary crimps. The polyester fibers crimped according to the disclosed method have substantially uniform primary and secondary crimps, and are further characterized by tensile factor that is about the same as the tensile factor possessed by an otherwise identical uncrimped polyester fiber.

32 Claims, 3 Drawing Sheets

POLYESTER FIBERS HAVING SUBSTANTIALLY UNIFORM PRIMARY AND SECONDARY CRIMPS

CROSS-REFERENCE TO RELATED APPLICATION

A This application is a continuation-in-part of U.S. application Ser. No. 09/274,190, filed Mar. 22, 1999, now U.S. Pat. No. 6,134,758, and is also related to copending U.S. application Ser. No. 09/629,293, pending, which itself is a continuation of U.S. application Ser. No. 09/274,190, now U.S. Pat. No. 6,134,788.

FIELD OF THE INVENTION

The invention relates to stuffer box methods for crimping polyester fibers. More particularly, the invention employs novel stuffer box geometry to produce crimped polyester fibers having substantially uniform primary and secondary crimps. In a preferred embodiment, the method results in polyester fibers, batting, fiberfill, yarn, carpet, and other improved products that are difficult, or even impossible, to produce by employing conventional polyester crimping procedures.

BACKGROUND OF THE INVENTION

Conventional methods of producing crimped fibers using a stuffer box apparatus are well known, and generally include directing fibers between two driven rollers to force the fibers into a confined space (i.e., the stuffer box chamber). The stuffer box typically includes opposing doctor blades positioned close to a nip, which is formed by the two rollers. Side plates, and occasionally base plates as well, complete the crimping chamber. As the fibers are fed through the nip into the stuffer box chamber, the fibers accumulate, decelerate, and fold. The resulting fiber bends are referred to as "primary" crimps.

To facilitate the formation of primary crimps, a stuffer box is typically equipped with a flapper, which is located toward the back of the crimping chamber. An applied force moves the flapper deep into the crimping chamber, further restricting fiber movement through the stuffer box. This augments the forces exerted on the advancing fibers by the top and bottom doctor blades.

Exemplary stuffer box descriptions are set forth in U.S. Pat. Nos. 5,025,538; 3,353,222; 4,854,021; 5,020,198; 5,485,662; 4,503,593; 4,395,804; and 4,115,908. It will be understood, of course, that these patents provide a descriptive background to the invention rather than any limitation of it. The basic stuffer box design may be modified to include or exclude parts. Although by no means is this list of patents exhaustive, the disclosed patents nevertheless illustrate the basic stuffer box, structural elements.

Conventional crimping methods often fail to manipulate the stuffer box settings to produce fibers having substantially uniform primary and secondary crimps. This can result in fibers that demonstrate relatively poor crimp uniformity, and consequently variable and inconsistent fiber properties. As will be understood by those having quality control backgrounds, use of such inferior fibers in manufacturing certain products is undesirable.

For example, as a general matter, more crimps per unit length increases cohesion and, conversely, fewer crimps per unit length decreases cohesion. Depending on fiber use, cohesion may be advantageous (e.g., carding) or disadvantageous (e.g., fiberfilling). Regardless of the end use, fiber uniformity is beneficial because crimps per unit length may be maintained at a frequency that results in an optimal cohesion, whether high or low. In short, consistent fiber crimping means less deviation from the desired cohesion level. This promotes better quality control.

To the extent that the prior art discloses techniques to improve fiber crimp uniformity, the focus is exclusively upon ways to improve primary crimps. Nevertheless, fibers possessing regular primary crimps can fold into larger deformations as the fibers advance through the stuffer box chamber. These larger fiber deformations are referred to as "secondary crimps." Each secondary crimp fold includes a plurality of primary crimp folds. The formation of secondary crimps depends, in part, upon the gap height between the doctor blades.

Conventional methods which recognize that secondary crimps can form within a common stuffer box apparatus nonetheless fail to teach or suggest regulating the fold dimensions of secondary crimps to provide desirable fiber properties. This is apparent by examining fibers that have emerged from a conventional stuffer box chamber the step of the folds is usually non-uniform.

The present invention recognizes, however, that primary and secondary crimp uniformity reduces the variability of polyester fiber properties. Such quality control with respect to crimp uniformity improves the manufacturing operations that process polyester fibers. As will be understood by those with quality control experience, reducing manufacturing variability leads to better quality products. Therefore, a need exists for producing crimped fibers having substantially uniform primary and secondary crimps.

OBJECT AND SUMMARY OF THE INVENTION

It is an object of the invention to produce polyester fibers having uniform primary and secondary crimps. It is a further object of the invention to produce such crimped polyester fibers by employing novel geometry within a longitudinal stuffer box chamber.

In a primary aspect, the invention is an improved method for processing polyester fibers through a stuffer box crimping apparatus. As used herein, "polyester" is any long-chain synthetic polymer composed of at least 85 percent by weight of an ester of a substituted aromatic carboxylic acid. The invention improves upon conventional stuffer box methods by narrowing the gap between the doctor blades and increasing the tip spacing (i.e., the distance between the doctor blade tips and the roller surface). This promotes the formation of substantially uniform primary and secondary crimps. Surprisingly, it also improves production throughput while improving fiber uniformity.

As a general matter, a gap between the doctor blades that is too narrow prevents the formation of secondary crimps. Conversely, a gap between the doctor blades that is too wide results in non-uniform primary and secondary crimps. The present method sets the stuffer box height as a function of fiber properties particularly total denier per tow band width According to the *Dictionary of Fiber & Textile Technology* (Hocchst Celanese 1990), "total denier" is the denier of the tow before it is crimped, and is the product of denier per fiber and the number of fibers in the tow. Adhering to the relationship as herein disclosed maintains primary and secondary crimps in the advancing fibers that are substantially uniform, rather than irregular. In practice, the resulting crimp uniformity is demonstrated by the reduced movement of the flapper, which maintain a constant pressure upon the aggregation of fibers. The secondary crimp has predictable, not random, amplitude and percent. In general, "percent crimp" refers to the lend of a fiber segment after crimping divided by the length of the same fiber segment before crimping. It is believed that became the same longitudinal force produces the primary and secondary crimps, secondary crimp uniformity is a good indicator of primary crimp uniformity, and vice-versa.

In a second aspect, the invention is a polyester fiber product having uniform primary and secondary crimps. This crimp uniformity significantly reduces deviation with respect to fiber properties, such as cohesion, handling, and web strength (i.e., these properties become more predictable). It is believed that, all things being equal, crimp uniformity also increases breaking tenacity. Moreover, such uniformity increases the ability of a packaged, fiber aggregation to separate easily, sometime referred to as "openability." The improved crimp in the crimped fiber also improves resistance to compression on a per weight basis, a most desirable characteristic for fiberfill. As will be understood by those of skill in the art, resistance to compression means the ability of a bulk of material to withstand an applied force without reduction.

In many instances, the user of crimped polyester fibers must sacrifice one desirable fiber property to achieve another. The present invention facilitates this by enabling the user of crimped polyester fibers to specify the properties of the crimped fibers within narrow limits and have such demands fulfilled. In conformance with well-understood quality control principles, minimizing crimp non-uniformity of polyester fibers facilitates the improved manufacture of products, such as batting and fiberfill.

The foregoing, as well as other objects and advantages of the invention and the manner in which the same are accomplished, is further specified within the following detailed description and the accompanying drawings, in which:

DETAILED DESCRIPTION

The present invention is a method for producing polyester fibers having uniform primary and secondary crimps. The method employs a stuffer box crimping apparatus that, although conventional in its elements, is operated in a novel and nonobvious manner to produce uniformly crimped fiber.

Figure 1:
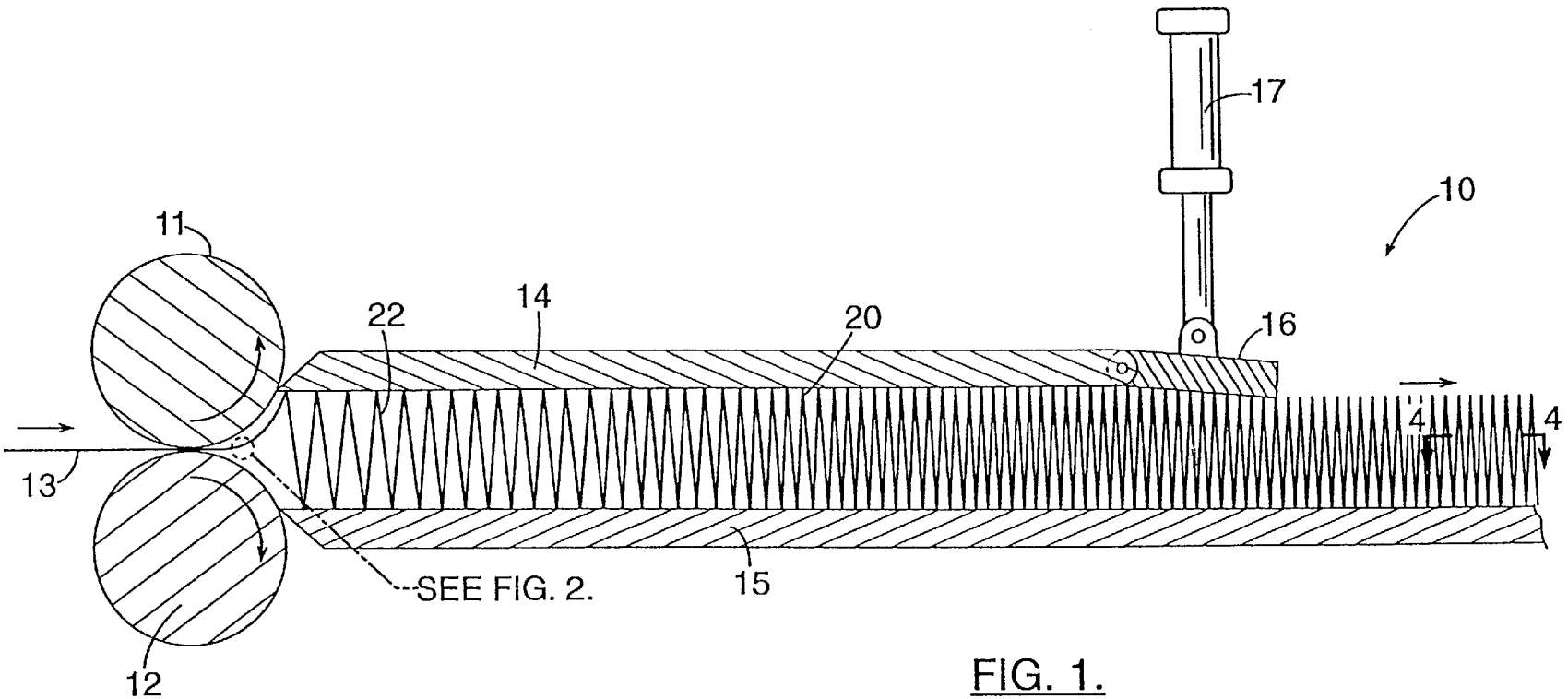
FIG. 1 is a longitudinal schematic view of a stuffer box that can be used in the present invention.

FIG. 1 illustrates the basic features of a stuffer box broadly designated at 10. In its basic aspects, the stuffer box 10 includes respective rollers 11 and 12 that define a nip through which fibers 13 advance. In most cases, the fibers 13 have not previously been crimped. Although the description of the invention primarily addresses fibers that are initially untextured, it will be understood by those of skill in the art that the invention is not necessarily limited to such stock material.

As FIG. 1 further illustrates, the stuffer box chamber 20 is formed by an upper doctor blade 14 and a lower doctor blade 15. Sidewalls, which are not illustrated in the longitudinal-section view of FIG. 1, may also be included in the stuffer box design. As will be understood by those skilled in the art, the bottom of the stuffer box can include a base plate, in addition to the lower doctor blade 15. The upper doctor blade 14 terminates in a flapper 16, which applies a certain constant pressure to control the movement of the crimped fiber layer. The pressure is applied by an appropriate air cylinder mechanism 17, or by other suitable means. The flapper 16 applies sufficient force, in part by physical obstruction, to ensure that the fibers will fold within the stuffer box chamber 20.

Figure 2:
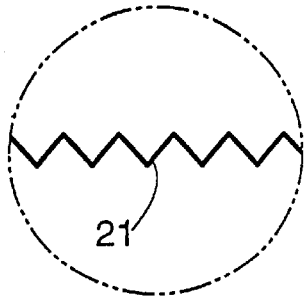
FIG. 2 is an enlarged detailed view of a portion of the fiber being crimped in the apparatus illustrated in FIG. 1.

The basic operation of a stuffer box is well understood in this art and will not be repeated in detail. It will be generally understood, however, that the stuffer box outlet is somewhat restricted as compared to the stuffer box inlet. Thus, as the rollers 11 and 12 continue to advance additional fibers 13 into the stuffer box 10, the fibers 13 are forced to fold in order to fit within the stuffer box chamber 20. The initial folding, which is illustrated in the detailed view of FIG. 2, forms an initial crimp that is generally referred to as a primary crimp 21.

As more fibers 13 are advanced into the stuffer box 10, however, additional folding can occur, which creates secondary crimps. These secondary crimps 22 are illustrated by the larger zigzag pattern in FIG. 1. Secondary crimps will fail to form, however, if the gap between the doctor blades is less than about the thickness of the primary crimped tow (i.e., too narrow). Alternatively, if the doctor blades are too far apart, the secondary crimps will tend to form irregularly and randomly.

The present method comprises applying sufficient longitudinal, compressive force against the advancing fibers 13 to impart primary crimps and then continuing to apply longitudinal force against the advancing primary crimped fibers 21 to impart a secondary crimp 22 to the advancing fibers. This is accomplished by maintaining a fixed geometry between the upper and lower doctor blades 14 and 15 at an inlet gap height that is sufficient to permit the secondary crimp to form, but that is narrow enough to ensure substantially regular secondary crimps. For example, in crimping a polyester fiber tow having a total denier of about 1,200,000, a gap setting of between about 12 mm to 18 mm—approximately half the conventional gap (30 mm or more)—forms and maintains uniform primary and secondary crimps.

In a preferred embodiment, the tip spacing is increased from the conventional 0.05 mm to between about 0.1 mm and 0.2 mm. As used herein, "tip spacing" refers to the shortest distance between a doctor blade and its adjacent roller. In reference to FIG. 1, the tips of the doctor blades 14 and 15 are positioned farther from the rollers 11 and 12 as compared with a conventional set-up. In another preferred embodiment, the doctor blades 14 and 15 are positioned so that the gap widens approximately 2° to 3° toward the outlet.

Because natural fibers tend to have significant textured properties—and indeed because the typical purpose of crimping is to impart more natural characteristics to synthetic fibers—the present method comprises advancing polyester fibers through the rollers 11 and 12 and into the confined space formed by the doctor blades 14 and 15 and the rollers 11 and 12. The force required to bend particular fibers 13 into primary and secondary crimps mainly depends upon the total denier of the fibers 13. Because the fibers are usually advanced as tow, the step of maintaining the gap between the upper and lower doctor blades preferably comprises setting the doctor blade gap as a function of the total denier per inch of tow-band width.

Polyester tow crimping trials indicate if the crimping ratio of total denier per inch of tow-band width to stuffer box inlet height is within a particular range, both the resulting primary and secondary crimps will be substantially uniform. The unit KDI (kilodenier per inch of tow-band width entering the stuffer box) characterizes a tow-band. (Kilodenier units are total denier units divided by 1000.) It will be understood by those skilled in the art that the crimping ratio, as well as other relationships disclosed herein, could be expressed by any convenient units of measurement.

A particularly good value for the crimping ratio is 16.3 KDI per millimeter of stuffer box height. The acceptable tolerance around this value appears to be plus or minus about ten percent. More specifically, it has been determined that the doctor blade gap at the stuffer box inlet is preferably set at a height determined by the following equation:

$$\text{gap height (mm)}=(KDI\div X),$$

wherein the variable X has a value of between about 14.5 KDI/mm and about 18 KDI/mm.

In preferred embodiments, the value of the variable X is about 16.3 KDI/mm.

As will be understood by those skilled in the art, the above-mentioned equation is necessarily adjusted for application to hollow polyester fibers. In particular, a hollow fiber having a certain cross-sectional area will have a proportionally lower weight per unit length relative to a solid fiber made of the same composition and having the same cross-sectional area. This linear relationship may be expressed as a function of the hollow fiber's solid fraction:

$$\text{denier (hollow fiber)}=\text{denier (solid fiber)}\cdot s,$$

wherein the hollow fiber and the solid fiber are of the same composition and have the same cross-sectional area, and wherein s is the ratio of the mass of the hollow fiber to the mass of the solid fiber (i.e., the solid fraction of the hollow fiber).

Accordingly, the modified crimping equation for hollow fibers is as follows:

$$\text{gap height (mm)}=(KDI\div s)\div(X),$$

wherein the variable s is the solid fraction of the hollow fibers and the variable X has a value of between about 14.5 KDI/mm and about 18 KDI/mm. Note that this is the more general form of the crimping equation (i.e., solid fibers have a solid fraction s of 1). In preferred embodiments, the solid fraction s of hollow polyester fibers is between about 0.72 and about 0.91.

As an exemplary and typical setting for the invention, if a tow formed from a plurality of polyester fibers having a total denier of about 1,790,000 is advanced into a stuffer box about 7.09 inches wide, the KDI is about 252 (i.e., 1,790 kilodenier÷7.09 inches). Thus, the gap height should be maintained at between about 14 mm and about 17 mm. To achieve efficient crimping production, the tow formed from a plurality of 15 denier per filament (DPF) polyester fibers preferably has a total denier of at least about 500,000. For example, a total denier of between about 500,000 and 4,000,000 provides acceptable stuffer box output.

Processing fiber in this way yields improved fibers having uniform primary and secondary crimps. Thus, in another aspect, the invention is a polyester fiber, having a weight-to-length ratio of less than about 500 DPF, substantially uniform primary crimps of between about 1.5 and 15 crimps per linear inch, and substantially uniform secondary crimps.

More specifically, crimp uniformity is desirable in fibers having a weight-to-length ratio of less than about 50 DPF, especially so in fibers having weight-to-length ratio of less than about 15 DPF. In this regard, the uniformly crimped fibers of the present invention preferably have weight-to-length ratio between about 11–12 DPF, 6 DPF, and less than about 1.2 DPF. In particular, uniformly crimped fibers used in clothing preferably have a weight-to-length ratio between about 0.5 and 1.5 DPF, and more preferably between about 0.9 and 1.2 DPF.

In a preferred embodiment, the invention is a polyester fiber having a weight-to-length ratio of about 15 DPF, substantially uniform primary crimps of about 3.9 crimps per linear inch, and substantially uniform secondary crimps. In another preferred embodiment, the invention is a polyester fiber having a weight-to-length ratio of about 6 DPF, substantially uniform primary crimps of about 6 or 7 crimps per linear inch, and substantially uniform secondary crimps.

Figure 3:
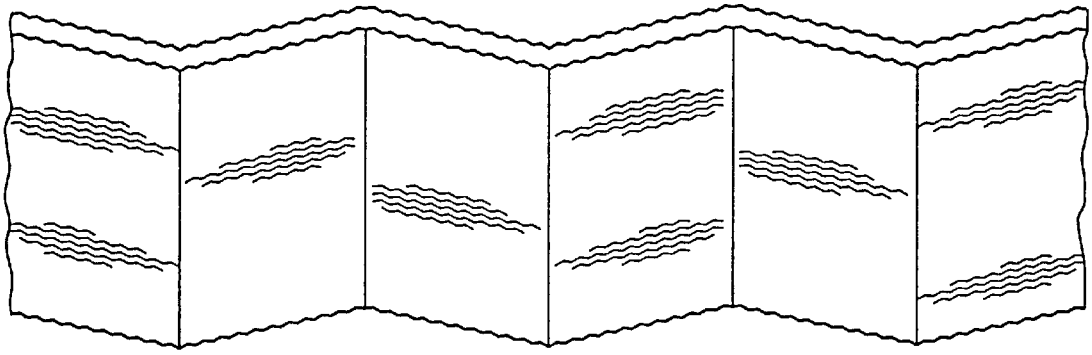
FIG. 3 is a top view of the fiber tow illustrating the formation of the secondary crimped fibers.
Figure 4:
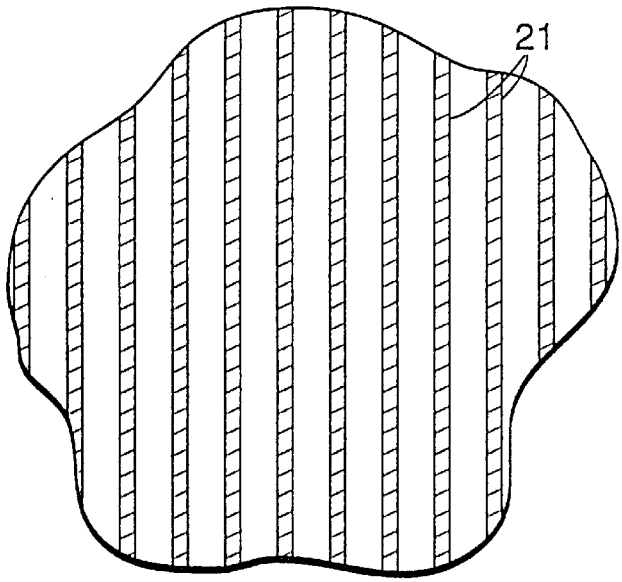
FIG. 4 is a schematic top view, taken along lines 4—4 of FIG. 1, of the uniform, transverse peaks defined by the secondary fiber crimps.

By following this novel crimping technique, the secondary crimp 22, which is random in fibers processed through typical stuffer box arrangements, tends to be maintained in an extremely regular pattern. This is illustrated by the detail view of FIG. 3. Furthermore, the crimped fibers emerging from the stuffer box possess secondary crimps that are exceptionally uniform in the transverse direction. More specifically, the secondary crimps 22 form into periodic rows that are parallel to the nip (i.e., extending across the width of the stuffer box chamber). This is illustrated by the detail view of FIG. 4, which shows the orientation of the secondary crimp peaks. Those of ordinary skill in this art will recognize the primary and secondary crimp uniformity by observing the tow as it exits the stuffer box.

According to the test method of Dr. Vladimir Raskin, crimp non-uniformity can be defined by crimp deviation from the average crimp frequency (i.e., crimps per inch or crimps per centimeter). This is represented by $K_n$, a coefficient of primary crimp non-uniformity. $K_n$ is calculated by extending a sample section of crimped tow, preferably between about 50 centimeters and about 100 centimeters, such that the secondary crimps disappear.

To achieve a $K_n$ value, a measuring stick or tape measure having small gradations is first placed lengthwise along a section of tow, preferably along the tow midline as crimping is usually most stable there. Then, this section of crimped tow is divided into equal subsections. For simplicity, the subsections are typically one centimeter or one inch in length. It should be understood, however, that because $K_n$ is an averaged value any convenient unit length could be used to calculate $K_n$. Primary crimps per unit length are then calculated for the successive subsections along the tow (e.g., crimps per centimeter for each tow subsection).

Next, a mean value of crimps per unit length ($X_m$) is determined by totaling the crimps along the sample tow section and dividing by the tow section length. The percent absolute deviation from $X_m$ is then calculated for each tow subsection. $K_n$ is defined as a sum of the percent absolute deviations from $X_m$ divided by the number of tow subsections analyzed. Thus, $K_n$ reflects the average deviation from $X_m$, the mean value of crimps per unit length, at a relative position across the tow (e.g., along the right edge or, preferably, along the midline).

As an illustration of how $K_n$ is calculated, refer to Table 1 (below), which characterizes a 10-centimeter section of tow having 10 subsections:

TABLE 1

| Subsection | Crimps per cm | Absolute Deviation from $X_m$ (2.4 crimps/cm) | Percent Absolute Deviation from $X_m$ (2.4 crimps/cm) |
|---|---|---|---|
| A | 3.0 | 0.6 | 25 |
| B | 2.0 | 0.4 | 17 |
| C | 1.0 | 1.4 | 58 |
| D | 2.5 | 0.1 | 4 |
| E | 3.5 | 1.1 | 46 |
| F | 1.5 | 0.9 | 38 |
| G | 3.0 | 0.6 | 25 |
| H | 2.5 | 0.1 | 4 |
| I | 2.0 | 0.4 | 17 |
| J | 3.0 | 0.6 | 25 |
| Σ = 10 cm | Σ = 24 crimps | Σ = 6.2 | Σ = 259 |

According to this illustrative example, $X_m$, the mean value of crimps per unit length, is 2.4 crimps per centimeter. The percent absolute deviation from $X_m$ is 259 percent for the 10 subsections, Thus, $K_n$ for this 10-centimeter tow section is about 26% (i.e., 259%÷10).

Furthermore, the $K_n$ values for several positions across the tow width may be averaged to result in a pooled $K_n$ value. For example, $K_n$ is often calculated at the five positions across the tow that divide the tow width into lengthwise quadrants (i.e., $K_n$ at the tow midline, $K_n$ at each of the two tow edges, and $K_n$ at each of the two mid-points defined by the tow midline and the two tow edges). The pooled $K_{n5}$ is simply the average of the five $K_n$ values. It will be appreciated by those of ordinary skill in this art that the crimps at the extreme edges of the tow tend to be less uniform than the crimps at the midline, probably because of frictional forces imparted by the stuffer box sidewalls. Accordingly, it is recommended that any evaluation of Kn at a tow edge use a portion of the tow at least about one centimeter from that edge.

Table 2 (below) shows such pooled $K_{n5}$ values for polyester fibers crimped in a conventional stuffer box, which has an inlet height of 31 millimeters, and pooled $K_{n5}$ values for polyester fibers crimped in the improved stuffer box, which has an inlet height of 13 millimeters. In referring to Table 2, note that examples 1 through 7 employed conventional stuffer box geometry, whereas examples 8 and 9 employed the novel stuffer box geometery of the present invention. In brief, $K_{n5}$ for the improved polyester fibers of the present invention (8.3% and 10.8%) is considerably less than $K_{n5}$ for conventional 13.8% to 17.4%).

TABLE 2

| N | Fiber Denier | CPLI (crimps per linear inch) | Stuffer Box Inlet Height (mm) | $K_{n5}$ (%) |
|---|---|---|---|---|
| 1 | 6.0 | 9.0 | 31 | 15.6 |
| 2 | 6.0 | 10.5 | 31 | 16.3 |
| 3 | 15.0 | 9.5 | 31 | 17.4 |
| 4 | 15.0 | 5.0 | 31 | 16.8 |
| 5 | 4.75 | 12.0 | 31 | 13.8 |
| 6 | 15.0 | 7.0 | 31 | 14.1 |

TABLE 2-continued

| N | Fiber Denier | CPLI (crimps per linear inch) | Stuffer Box Inlet Height (mm) | $K_{n5}$ (%) |
|---|---|---|---|---|
| 7 | 15.0 | 9.5 | 31 | 16.2 |
| 8 | 15.0 | 10.0 | 13 | 8.3 |
| 9 | 15.0 | 10.0 | 13 | 10.8 |

As will be understood by those skilled in the art, reducing process variability improves manufacturing processes. Thus, the regular characteristics of the primary and secondary crimped fibers, particularly a plurality of such fibers, are advantageous for end-use applications. In addition, fibers having uniform primary and secondary crimps demonstrate improved handling and web strength.

According to the *Dictionary of Fiber & Textile Technology* (Hoechst Celanese 1990), "factor" is defined as "the empirical factor $T \cdot E^{1/2}$ that describes the tenacity-elongation exchange relationship for a large number of manufactured fiber systems." A significant advantage of the present invention is that the uniformly crimped polyester fibers retain tensile factor despite being processed through a stuffer box. Stated differently, the uniformly crimped polyester fibers possess strength characteristics that are nearly the same as the strength characteristics possessed by an otherwise identical uncrimped polyester fiber. In particular, the present method of crimping polyester fibers results in a tensile factor reduction of less than about five percent.

It will be understood by those of ordinary skill in the art that tenacity and elongation have an inverse relationship. Tensile factor provides a convenient way to measure changes in strength characteristics while considering the relationship between tenacity and elongation. For example, although drawing will simultaneously increase a filament's tenacity and decrease its elongation, the filament's characteristic tensile factor remains constant, provided the drawing does not damage the filament. A corollary to this is that a significant change in tensile factor indicates filament damage.

As will be known by those of ordinary skill in the art, gear crimping and related techniques can also provide crimp uniformity. To achieve crimp uniformity in this way, filaments are fed through meshing gear teeth to deform the filaments in the shape of the gear teeth. The resulting, forced deformations are often made permanent through heat setting. The aggressive, mechanical texturing of gear crimping subjects the filaments to tremendous energy. Consequently, gear-crimped fibers exhibit structural damage, which is exemplified by significantly reduced tensile factor. In other words, gear crimping techniques deliver precise crimp uniformity, but sacrifice fiber strength characteristics (i.e., the tenacity-elongation relationship is negatively affected). Laboratory experiments using a heated gear (65° C.) having ten gear teeth per inch to impart crimps to 15 DPF filaments suggest that even mild gear crimping causes about a 30 percent decrease in tensile factor.

It is believed that gear crimping to impart the planar zigzag pattern of the uniformly crimped polyester fiber of the present invention will result in even more fiber damage, and hence weaker fibers, than gear crimping to impart a sinuous crimp pattern. In either case, however, gear crimping techniques mechanically force crimps at a particular frequency. The inherent fiber damage caused by gear crimping techniques is simply worse when gears impart crimps having sharp angles, rather than gradual curves. In contrast, the stuffer box crimping of the present invention permits filaments to buckle naturally in response to applied forces, thereby retaining filament strength characteristics as measured by tensile factor.

As will be further understood by those of ordinary skill in the art, weakened fibers cause breakage problems during subsequent textile operations. Moreover, the poor elongation characteristics of gear-crimped fibers renders them largely unsuitable for applications where elasticity is important, such as weaving. Finally, because gear-crimped fibers suffer damage at each point where the gears mesh, such fibers are difficult to dye uniformly (i.e., dye uptake varies, and is usually poorer, in these gear-crimped locations).

In another aspect, the invention is batting formed from a plurality of polyester fibers having uniform primary and secondary crimps. As will be understood by those of skill in the art, batting is a soft, bulky assembly of fibers. It is usually carded, and is often sold in sheets or rolls. Batting is used for outer lining, comforter stuffing, thermal insulation, resilient items (e.g., pillows, cushions, and furniture), and other applications. Uniformly crimped fibers are more predictably manufactured into batting in part because a mass of such fibers possesses regular openability.

In yet another aspect, the invention is fiberfill formed from a plurality of polyester fibers having uniform primary and secondary crimps. As will be understood by those of skill in the art, fiberfill is an aggregation of manufactured fibers that has been engineered for use as filling material in pillows, mattress pads, comforters, sleeping bags, quilted outerwear, and the like. The improved characteristics of the present fiberfill is partly a result of the planar zigzag pattern of the uniformly crimped fibers, which tend to entangle in a way that helps resistance to compression. This is an especially desirable property with respect to seat cushions.

Moreover, the improved fiberfill of the present invention has fewer uncrimped fibers as compared with conventional fiberfill. Uncrimped fibers contribute little to resistance to compression, but nonetheless increase fiberfill weight. Thus, using the fibers of the present invention means less fiberfill is needed to achieve a desired level of resistance to compression. In other words, fiberfill formed according to the present invention tends to have a higher resistance to compression on a per weight basis than does conventional fiberfill. Using less fiberfill and yet maintaining acceptable resistance to compression reduces fiberfilling expenses.

In still another aspect, the uniformly-crimped fibers and tow according to the present invention can be formed into yarns by any appropriate spinning method that does not adversely affect the desired properties. In turn, the yarns can be formed into fabrics, or, given their advantageous properties, carpets or other textile products.

As noted, controlling the making of primary and secondary crimps is important ii.; because deviations from target primary and secondary crimp values can cause manufacturing problems. For example, primary crimp control is an especially important consideration in fiberfilling operations. Users of polyester fiberfill typically have demanding specifications. In general, as crimp frequency becomes excessive, clumps of unopened fiber choke the blowers, forcing them to be shut down and cleared.

To illustrate, in some blowers, 15 DPF, 3.9 CPLI polyester fibers have very good openability and very uniform cushion quality, while 15 DPF, 4.0 CPLI polyester fibers cause chokes and tangles in the blower, as well as lumpy, poorly filled cushions. Furthermore, when crimp frequency of the polyester fibers increases to 4.8 CPLI, chokes and tags develop in these blowers, typically causing machine downtime. The resulting cushions are poorly filled—especially in the corners—and tend to be very lumpy. In other blowers 15 DPF, 4.0 CPLI polyester fibers will possess good openability and will uniformly fill cushions, whereas 15 DPF, 4.5 CPLI polyester fibers, while possessing good openability, will distribute poorly, leading to lumps and voids in the cushions.

In brief, users of polyester fibers typically have narrow specifications within which polyester fibers are best processed. The present stuffer box crimping method, by promoting excellent quality control, better meets such customer limitations as compared to conventional stuffer box methods.

Secondary crimp control is also important when blowing fibers into cushions. Trials indicate that in some fiberfilling equipment a 25 percent secondary crimp leads to poor openability because the fibers tend to tangle, whereas a 16.5 percent secondary crimp leads to good performance.

Figure 5:
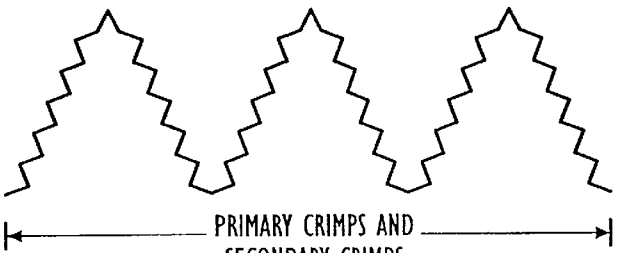
FIG. 5 is a side view of a fiber having primary and secondary crimps.
Figure 6:
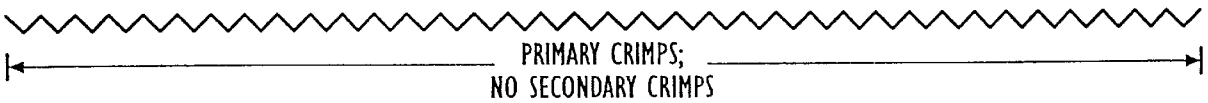
FIG. 6 is a side view of a straightened fiber having only primary crimps.

FIG. 5 illustrates a fiber having both primary and secondary crimps. FIG. 6 illustrates the fiber of FIG. 5 that has been extended to release the secondary crimps, but not the primary crimps. Moreover, FIG. 7 illustrates the fiber of FIG. 6 that has been further extended to release the primary crimps.

Figure 7:
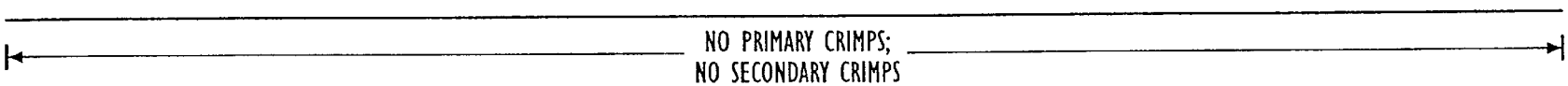
FIG. 7 is a side view of a straightened fiber having neither primary crimps or secondary crimps.

Schematically, percent total crimp is the ratio of the length of the fiber represented in FIG. 5 to the length of the fiber represented in FIG. 7.

Schematically, percent primary crimp is the ratio of the difference between the length of the fiber represented in FIG. 7 and the length of the fiber represented in FIG. 6, to the length of the fiber represented in FIG. 7. More specifically, the percent primary crimp may be calculated from the following equation:

$$\text{percent primary crimp}=((SL_f-SL_h)\div(SL_f))\cdot 100\%$$

wherein $SL_h$ is the hypothetical extended length of the same crimped tow stretched to release the secondary crimps while maintaining the primary crimps (see FIG. 6); and wherein $SL_f$ is the actual extended length of the same crimped tow stretched to release both the primary and the secondary crimps, i.e., the fiber cut length (see FIG. 7).

Schematically, percent secondary crimp is the ratio of the difference between the length of the fiber represented in FIG. 6 and the length of the fiber represented in FIG. 5, to the length of the fiber represented in FIG. 7. More specifically, the percent secondary crimp may be calculated from the following equation:

$$\text{percent secondary crimp}=((SL_h-SL_i)\div(SL_f))\cdot 100\%$$

wherein $SL_i$ is the unextended length of a tow having both primary and secondary crimps (see FIG. 5);

wherein $SL_h$ is the hypothetical extended length of the same crimped tow stretched to release the secondary crimps while maintaining the primary crimps (see FIG. 6); and wherein $SL_f$ is the actual extended length of the same crimped tow stretched to release both the primary and the secondary crimps, i.e., the fiber cut length (see FIG. 7).

The crimped fibers of the present invention preferably have total crimp between about 10 and 90 percent, preferably between about 10 and 40 percent, and more preferably between 20 and 40 percent. In this regard, the substantially uniform primary crimps provide between about 5 and 20 percent primary crimp. Similarly, the substantially uniform secondary crimps provide between about 5 and 20 percent secondary crimp. As will be known to those of ordinary skill in the art, higher percentages of total crimp are useful for fiberfill where bulk is important, and lower percentages of total crimp are useful for undergarments, such as diapers.

Thus, in one particular embodiment, the invention is a polyester fiber having a weight-to-length ratio of about 15 DPF, substantially uniform primary crimps of about 4 CPLI, and substantially uniform secondary crimps of about 16.5 percent.

As will be understood by those skilled in the art, other process variables affect crimp control. For example, the force exerted by the flapper can be increased to further restrain the tow in the stuffer box, and thus increase crimps per unit length. Conversely, the flapper force can be lowered to decrease crimps per unit length. As an illustration, trials using 6 DPF polyester fibers show that a flapper force of about 179 pounds leads to 7.2 CPLI. In contrast, a reduced flapper force of about 156 pounds results in 6.0 CPLI. Similarly, trials using 15 DPF polyester fibers demonstrate that a flapper force of about 113.6 pounds leads to 5.0 CPLI, whereas a flapper force of 10.9 pounds results in about 4.0 CPLI. In these trials, the force exerted by the flapper was varied by changing air cylinder pressure.

As will be known by those of skill in the art, crimp characteristics affect fiber properties. Experimental results using 3-gram samples of carded polyester fiber illustrate the relationship between crimp frequency and resistance to compression. For example, a 15 DPF polyester fiber having a 3.5 CPLI has a resistance to compression of 1.75 pounds.

In comparison, the same polyester fiber having a 6.0 CPLI has a resistance to compression of about 2.15 pounds.

Other experiments using 3-gram samples of carded polyester fibers illustrate the relationship between secondary crimp percent and resistance to compression. For example, a 15 DPF polyester fiber having an 8 percent secondary crimp has a resistance to compression of about 1.77 pounds. In contrast, the same polyester fiber having a 22 percent secondary crimp has a resistance to compression of about 1.82 pounds.

Finally, trials indicate that the method disclosed herein substantially improves crimp uniformity and increases production throughput. For example, processing eight subtows of a 6 DPF polyester fiber through a standard stuffer box results in a $K_n$ value of about 17 percent. Conversely, the same stuffer box modified by the method disclosed herein handles 10 subtows and yet delivers crimped fibers having a $K_n$ value of about 13 percent.

Similarly, processing 12 subtows of a 15 DPF polyester fiber through a standard stuffer box results in a $K_n$ value of about 17.3 percent. By processing the same polyester product through the modified stuffer box of the present invention allows the throughput to increase to 14 subtows and yet reduces the $K_n$ value to about 8.3 percent.

The modified stuffer box of the present invention handles increased throughput when arranged for optimal crimp uniformity. As noted, the $K_n$ value is a way to quantify crimp uniformity. As reflected by the increased subtow throughput, stuffer box crimping according to the present invention not only improves crimp uniformity, but also increase production rates.

In the drawings and specification, typical embodiments of the invention have been disclosed. Specific terms have been used only in a generic and descriptive sense, and not for purposes of limitation. The scope of the invention is set forth in the following claims.

That which is claimed is:

1. A crimped polyester fiber, comprising:

substantially uniform primary crimps; and substantially uniform secondary crimps;

wherein each said substantially uniform secondary crimp includes a plurality of said substantially uniform primary crimps;

wherein the coefficient of primary crimp non-uniformity ($K_n$) possessed by said crimped polyester fiber is less than about 10.8 percent; and wherein the tensile factor possessed by said crimped polyester fiber is about the same as the tensile factor possessed by an otherwise identical uncrimped polyester fiber.

2. A crimped polyester fiber according to claim 1, wherein said substantially uniform primary crimps are planar zigzag crimps.

3. A crimped polyester fiber according to claim 1, wherein said crimped polyester fiber has between about 10 and 90 percent total crimp.

4. A crimped polyester fiber according to claim 1, wherein said crimped polyester fiber has between about 20 and 40 percent total crimp.

5. A crimped polyester fiber according to claim 1, wherein said substantially uniform primary crimps provide between about 5 and 20 percent primary crimp.

6. A crimped polyester fiber according to claim 1, wherein said substantially uniform secondary crimps provide between about 5 and 20 percent secondary crimp.

7. The crimped polyester fiber of claim 1, wherein the weight-to-length ratio of said polyester fiber is less than about 500 denier.

8. The crimped polyester fiber of claim 7, wherein the weight-to-length ratio of said polyester fiber is less than about 50 denier.

9. The crimped polyester fiber of claim 8, wherein the weight-to-length ratio of said polyester fiber is less than about 15 denier.

10. The crimped polyester fiber of claim 9, wherein the weight-to-length ratio of said polyester fiber is between about 11 and 12 denier.

11. The crimped polyester fiber of claim 9, wherein the weight-to-length ratio of said polyester fiber is about 6 denier.

12. The crimped polyester fiber of claim 9, wherein the weight-to-length ratio of said polyester fiber is less than about 1.2 denier.

13. The crimped polyester fiber of claim 1, wherein the substantially uniform primary crimps have a crimp frequency of between about 1.5 crimps per linear inch and about 15 crimps per linear inch.

14. The crimped polyester fiber of claim 13, wherein the substantially uniform primary crimps have a crimp frequency of between about 1.5 crimps per linear inch and about 4 crimps per linear inch.

15. The crimped polyester fiber of claim 13, wherein the substantially uniform primary crimps have a crimp frequency of between about 4 crimps per linear inch and about 12 crimps per linear inch.

16. The crimped polyester fiber of claim 13, wherein the substantially uniform primary crimps have a crimp frequency of between about 12 crimps per linear inch and about 15 crimps per linear inch.

17. The crimped polyester fiber of claim 1, wherein said polyester fiber is substantially evenly dyed.

18. Batting formed from the crimped polyester fiber of claim 1.

19. Fiberfill formed from the crimped polyester fiber of claim 1.

20. Yarn formed from the crimped polyester fiber of claim 1.

21. Carpet formed from the crimped polyester fiber of claim 1.

22. A crimped polyester fiber having a plurality of crimps, said crimps consisting of substantially uniform primary crimps and substantially uniform secondary crimps, wherein said crimped polyester fiber has between about 10 and 90 percent total crimp, wherein the coefficient of primary crimp non-uniformity ($K_n$) possessed by said crimped polyester fiber is less than about 10.8 percent, and wherein the tensile factor possessed by said crimped polyester fiber is about the same as the tensile factor possessed by an otherwise identical uncrimped polyester fiber.

23. A crimped polyester fiber according to claim 22, wherein said substantially uniform primary crimps are planar zigzag crimps.

24. A crimped polyester fiber according to claim 22, wherein said crimped polyester fiber has between about 10 and 40 percent total crimp.

25. A crimped polyester fiber according to claim 24, wherein:

said substantially uniform primary crimps provide between about 5 and 20 percent primary crimp;

said substantially uniform secondary crimps provide between about 5 and 20 percent secondary crimp.

26. The crimped polyester fiber of claim 22, wherein the weight-to-length ratio of said polyester fiber is less than about 50 denier.

27. The crimped polyester fiber of claim 26, wherein the weight-to-length ratio of said polyester fiber is less than about 15 denier.

28. The crimped polyester fiber of claim 27, wherein the weight-to-length ratio is selected from the group consisting of between about 0.5–1.5 denier, and about 6 denier, and between about 11–15 denier.

29. The polyester fiber of claim 22, wherein the substantially uniform primary crimps have a crimp frequency of between about 1.5 and 15 crimps per linear inch.

30. The polyester fiber of claim 22, wherein the substantially evenly dyed.

31. The crimped polyester fiber of claim 1, wherein the coefficient of primary crimp non-uniformity ($K_n$) possessed by said crimped polyester fiber is less than about 8.3 percent.

32. The crimped polyester fiber of claim 22, wherein the coefficient of primary crimp non-uniformity ($K_n$) possessed by said crimped polyester fiber is less than about 8.3 percent.

* * * * *

UNITED STATES PATENT AND TRADEMARK OFFICE

CERTIFICATE OF CORRECTION

PATENT NO. : 6,572,966 B1 
DATED : June 3, 2003
INVENTOR(S) : Raskin et al.

It is certified that error appears in the above-identified patent and that said Letters Patent is hereby corrected as shown below:

Title page,
Item [56], References Cited, FOREIGN PATENT DOCUMENTS,
"DE 3516886 A1", "11/1996" should read -- 11/1986 --.

Column 1,
Line 8, please delete "A".
Line 13, "6,134,788" should read -- 6,134,758 --.

Column 2,
Line 59, "Hocchst" should read -- Hoechst --.
Line 66, "maintain" should read -- maintains --.

Column 3,
Line 2, "lend" should read -- length --.
Line 4, "became" should read -- because --.

Column 7,
Line 52, "geometery" should read -- geometry --.
Line 55, after "conventional" insert -- ( --.

Column 14,
Line 16, after "wherein" insert -- said polyester fiber is --.

Signed and Sealed this

Eleventh Day of November, 2003

JAMES E. ROGAN
*Director of the United States Patent and Trademark Office*